United States Patent [19]

Huder

[11] Patent Number: 5,066,959

[45] Date of Patent: Nov. 19, 1991

[54] MODE COUPLER FOR MONOPULSE APPLICATIONS HAVING $H_{01}$ MODE EXTRACTING MEANS

[75] Inventor: Bernhard Huder, Ulm, Fed. Rep. of Germany

[73] Assignee: Telefunken Systemtechnik GmbH, Ulm, Fed. Rep. of Germany

[21] Appl. No.: 443,955

[22] Filed: Dec. 1, 1989

[30] Foreign Application Priority Data

Dec. 1, 1988 [DE] Fed. Rep. of Germany ..... 3840450

[51] Int. Cl.[5] ..... H01P 1/161; H01Q 25/02

[52] U.S. Cl. ..... 343/786; 333/137; 333/117; 342/153

[58] Field of Search ..... 333/137, 135, 125, 117, 333/122; 343/786, 756; 342/153, 427

[56] References Cited

U.S. PATENT DOCUMENTS

| | | | |
|---|---|---|---|
| 2,730,677 | 1/1956 | Boissinot et al. | 333/137 X |
| 2,820,965 | 1/1958 | Sichak | 343/756 |
| 4,047,128 | 9/1977 | Morz | 343/786 X |
| 4,365,253 | 12/1982 | Mörz | 343/786 |
| 4,473,828 | 9/1984 | Mörz et al. | 343/786 |
| 4,511,438 | 4/1985 | DiStefano et al. | 204/4 |
| 4,622,524 | 11/1986 | Morz | 333/21 A X |
| 4,707,702 | 11/1987 | Withers | 333/21 A X |

FOREIGN PATENT DOCUMENTS

| | | |
|---|---|---|
| 0041077 | 12/1980 | European Pat. Off. . |
| 0061576 | 2/1982 | European Pat. Off. . |
| 1930620 | 1/1970 | Fed. Rep. of Germany . |
| 3604431 | 8/1987 | Fed. Rep. of Germany . |
| 3604432 | 8/1987 | Fed. Rep. of Germany . |
| 2091494 | 7/1982 | United Kingdom . |

OTHER PUBLICATIONS

Davis, Daniel, "Corrugations Improve Monopulse Feed Horns", *Microwaves*, Apr. 1972, pp. 58–60.

Beardow, T., "Waveguide Manufacturing Techniques", *British Communication and Electronics*, Oct. 1958, pp. 772–778.

Skolnik, "Radar Handbook", 1970, pp. 21–18–21–23.

*Primary Examiner*—Eugene R. LaRoche
*Assistant Examiner*—Benny T. Lee
*Attorney, Agent, or Firm*—Spencer & Frank

[57] ABSTRACT

A mode coupler for monopulse applications in an antenna feed system which is used for obtaining angle deviations in azimuth and elevation, and which has a main wave guide in which a plurality of electromagnetic wave modes can be propagated. The mode coupler also has a plurality of mode-selective in/out coupling ports which are all formed as simple standard wave guides mounted on the main wave guide, and in which only the $H_{10}$ mode is propagatable. A separator plate is disposed in the main wave guide to convert the $(H_{11}+E_{11})$ mode into two phase-opposed wave guide waves and, via a coupling loop, to couple them into a second wave guide mounted laterally on the main wave guide. The front edge of the separator plate forms a reflector for the $H_{01}$ mode, and the reflected $HO_1$ wave is coupled out of the main wave guide by a pair of wave guides mounted symmetrically on the main wave guide and connected via an H-plane junction to a common output wave guide.

5 Claims, 3 Drawing Sheets

FIG. 2a
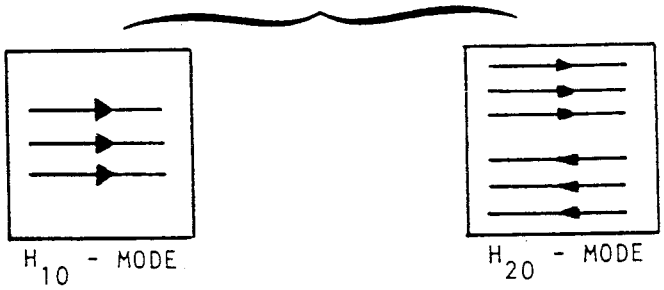
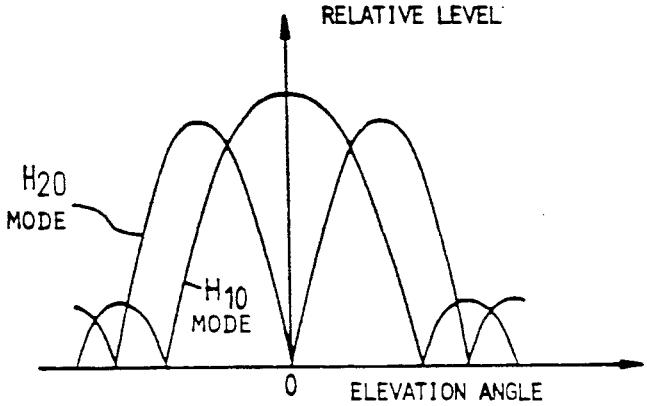
FIG. 2b
FIG. 2c
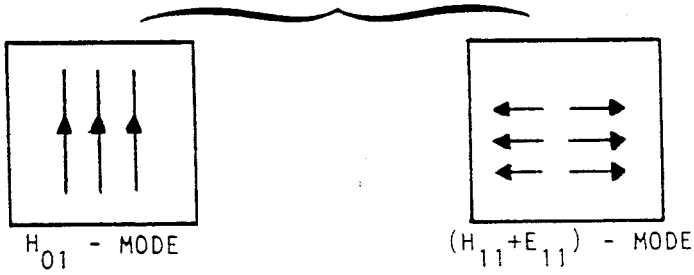
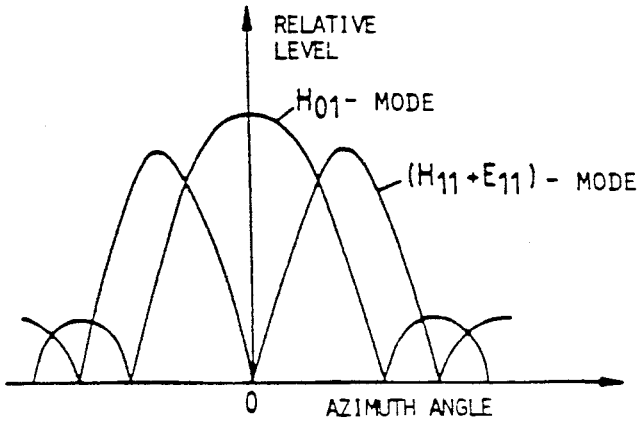
FIG. 2d

MODE COUPLER FOR MONOPULSE APPLICATIONS HAVING $H_{01}$ MODE EXTRACTING MEANS

BACKGROUND OF THE INVENTION

The invention relates to a mode coupler for monopulse applications in an antenna feed system for obtaining angle deviations in azimuth and elevation. More particularly, the present invention relates to a mode coupler having a main wave guide for electromagnetic waves in which a plurality of wave modes of the electromagnetic waves can be propagated, a plurality of mode-selective input and/or output coupling ports, each formed of standard wave guides in which only the $H_{10}$ mode can propagate mounted on the main wave guide, and a separator plate disposed in the main wave guide to convert the $(H_{11}+E_{11})$ mode in the main wave guide into two phase-opposed waves which is coupled via a coupling loop into a second wave guide mounted laterally with respect to the main wave guide, and with the front edge of the separator plate serving as a reflector for the $H_{01}$ mode. Such a mode coupler is known, for instance, from published German Patent Application DE 36 04 432 A1. A similar mode coupler arrangement is described in published German Patent Application DE 36 04 431 A1.

The dimensions of the main wave guide in the aforementioned known mode couplers are selected to be large enough so that all the relevant wave guide modes of the electromagnetic waves can be propagated. However, the dimensions are not so large that undesirable wave guide modes are propagated that could lead to erroneous received signals. By mode-sensitive coupling out of the electromagnetic waves having the $H_{10}$ and $H_{20}$ modes, signals can be obtained for production of a sum diagram and a differential diagram (direction finding diagram) in the elevation direction, as is known. The end of the main wave guide is connected to additional wave guide structure reduced in stages down to a standard wave guide format. The electromagnetic waves having the $H_{10}$ mode are coupled out at the end of the wave guide train in a straight line at a location where the main wave guide has been reduced in stages down to the standard wave guide format. The electromagnetic waves having the $H_{20}$ mode are coupled out by a laterally mounted wave guide. The electromagnetic waves having the $(H_{11}+E_{11})$ mode, furnishing the differential signal diagram representing the angle deviations in the azimuth, are converted in the aforementioned known mode coupler in the main wave guide by a separator plate into two phase-opposed wave guide waves, as is known in principle from European Patent 0 061 576, corresponding to U.S. Pat. No. 4,473,828. The energy of the electromagnetic waves having the $(H_{11}+E_{11})$ mode then is selectively coupled out from the main wave guide and coupled into another laterally mounted wave guide by a coupling loop.

The similarly designed mode coupler for monopulse applications in an antenna feed system known from German Patent 36 04 431 A1 also is used to obtain angle deviations in azimuth and elevation and comprises a main wave guide in which a plurality of modes can be propagated. A plurality of mode-selective in and/or out coupling ports are mounted on the main wave guide. A further in and/or out coupling port for in/out coupling a mode orthogonal to the sum mode is embodied as a simple wave guide mounted on the main wave guide, in which only the $H_{10}$ fundamental wave type can be propagated. A metal reflector is introduced into the main wave guide and reflects the orthogonal mode into the wave guide mounted on it.

Other mode couplers for monopulse applications are described for instance in the textbook entitled *Radar Handbook* by Skolnik, publ. by McGraw-Hill 1970, Chapter 21, pp. 18 ff, and in European Patents 0 061 576 and 0 041 077.

However, the disadvantage of these last-mentioned known couplers is in that to obtain one of the two deviation signals, they use an out coupling arranging which is complicated to produce and includes an EH-plane junction (magic-T). In the arrangement described in the Skolnik textbook, the differential signal formed by the $(H_{11}+E_{11})$ mode appears for instance at one output of the EH-plane junction, while a component of a sum signal can be coupled out at a second output. This coupled out component must be joined by a special joining apparatus to the sum signal to be coupled out at the actual summation gate, which necessitates further engineering effort.

SUMMARY OF THE INVENTION

An object of the invention is to provide a mode coupler of the type referred to in the foregoing, and which permits out coupling of further modes in a simple manner.

The above and other objects are accomplished according to the invention in that in a mode coupler for monopulse applications in an antenna feed system for obtaining angle deviations in azimuth and elevation including a main wave guide in which a plurality of electromagnetic wave modes can be propagated and having a plurality of mode-selective in and/or out coupling ports which are all simple standard wave guides mounted on the main wave guide and in which only the $H_{10}$ mode is propagatable, and a conductive separator plate which is disposed in the main wave guide and which converts the $(H_{11}+E_{11})$ mode into two phase-opposed wave guide waves and which couples them into a second wave guide mounted laterally on the main wave guide via a coupling loop, and with the front edge of the separator plate being a reflector for the $H_{01}$ mode; the improvement wherein the $H_{01}$ mode is coupled out of the main wave guide by a pair of standard wave guides having first respective ends mounted symmetrically on the main wave guide and having their respective other ends connected via an H-plane junction to a common output wave guide.

According to a further feature of the invention, the separator plate may be a metallized dielectric substrate on which electromagnetic mode coupling structures are etched.

According to another feature of the invention, an antenna may be coupled to the main wave guide, with the antenna being in the shape of a pyramidal horn. Alternatively, the antenna which is coupled to said main wave guide is in the shape of a corrugated horn.

According to another feature of the invention, the mode coupler is produced by an electroforming process.

Furthermore, if necessary, a polarization converter can be connected in the path between the main wave guide of the mode coupler and an antenna which is coupled to the main wave guide. The polarization converter can be embodied as a disk of double refraction material, or alternatively, can be in the form of a metal grid or grating.

BRIEF DESCRIPTION OF THE DRAWINGS

The invention will be described below in further detail referring to the drawings.

FIG. 2*a* shows the field diagrams of wave guide modes used, i.e., the $H_{10}$ and $H_{20}$ modes.

FIG. 2*b* shows the radiation lobes belonging to the $H_{10}$ and $H_{20}$ modes in the elevation plane.

FIG. 2*c* shows the field lines of the $H_{01}$ and the ($H_{11}$and $E_{11}$) wave guide modes.

FIG. 2*d* shows the radiation lobes to the $H_{01}$ and ($H_{11}$and $E_{11}$) modes in the azimuth plane.

DETAILED DESCRIPTION OF THE PREFERRED EMBODIMENT

Figure 1:
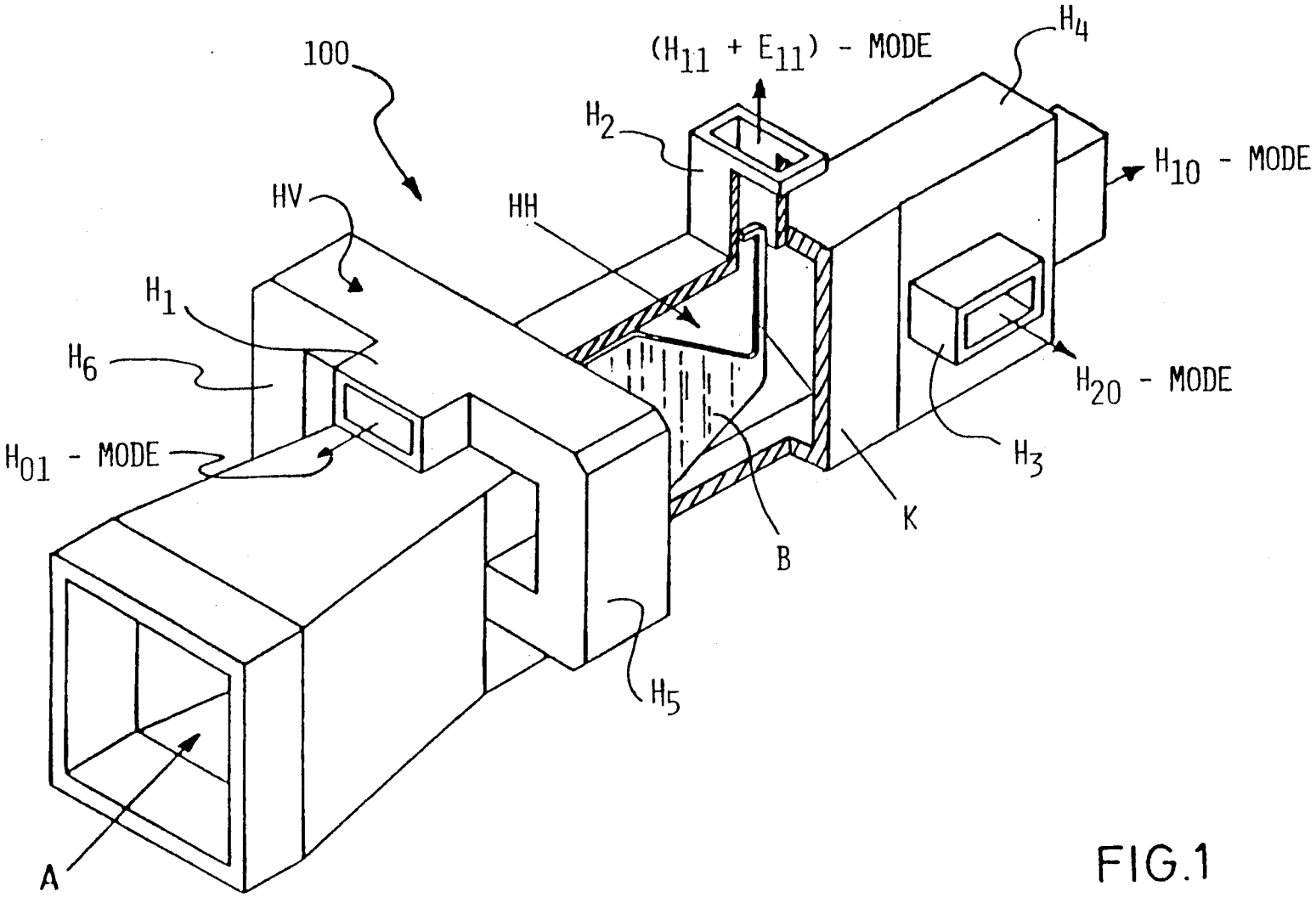
FIG. 1 shows an embodiment of a mode coupler according to the invention.

A mode coupler 100 is shown in FIG. 1 which has a basic design which is as described in the foregoing with respect to the known arrangement. The mode coupler 100 has a main wave guide portion HH which has dimensions which are selected to be large enough so that all the relevant wave guide modes can be propagated. However, the dimensions are not so large that undesirable wave guide modes are propagated which could lead to erroneous received signals. By mode-sensitive coupling out of the electromagnetic waves having the $H_{10}$ and $H_{20}$ modes, the field diagrams of which are shown in FIG. 2*a*, a sum and differential diagram (direction finding diagram) in the elevation plane (FIG. 2*b*) can be obtained. This portion of the mode coupling arrangement is substantially identical to the arrangement described in the Skolnik textbook.

As shown in FIG. 1, the $H_{10}$ mode is coupled out of the mode coupler at an end wave guide $H_4$ connected along a straight line to the main wave guide portion HH. At the location of the end wave guide $H_4$, the main wave guide portion HH has been reduced in stages down to a standard wave guide format for the electromagnetic waves having the $H_{10}$ mode. The electromagnetic waves having the $H_{20}$ mode are coupled out by a wave guide $H_3$ laterally mounted on the main wave guide HH. The mode coupler 100 has another laterally mounted wave guide $H_2$ which is used to couple out the electromagnetic waves having the ($H_{11}+E_{11}$) mode, which is used to produce a differential diagram in the azimuth plane. The ($H_{11}+E_{11}$) mode produced in the mode coupler 100 according to the invention in the main wave guide portion HH is split into two phase-opposed electromagnetic waves by a separator plate B, as is known in principle from European Patent 0 061 576 and corresponding U.S. Pat. No. 4,473,828. The ($H_{11}+E_{11}$) mode so produced is then selectively coupled into the laterally mounted wave guide $H_2$ by a coupling loop K. FIGS. 2*c* and 2*d* shows the field lines and relative level of the lobes of the ($H_{11}+E_{11}$) mode, respectively.

The mode coupler 100 according to the invention also includes a coupling arrangement for coupling out a mode orthogonal to the $H_{10}$ mode which is called the $H_{01}$ mode. The field diagram for the $H_{01}$ mode is shown in the left diagram of FIG. 2*c*, and the relative level of the $H_{01}$ mode as a function of the azimuth angle is shown in FIG. 2*d*. The electromagnetic waves having the $H_{01}$ mode are reflected at the front edge of the separator plate B and are coupled out through slits or windows (not shown) into a pair of wave guides $H_5$ and $H_6$ connected symmetrically to the main wave guide portion HH.

The two wave guides $H_5$ and $H_6$ are joined together via an H-plane junction HV, so that the electromagnetic waves having the $H_{01}$ mode can be coupled out via a common wave guide $H_1$. The separator plate B does not destroy the electromagnetic waves of the $H_{10}$ mode and $H_{20}$ mode travelling through the main wave guide HH. Instead of a metal separator plate B, a metallized dielectric substrate (not shown) on which the coupling structures are produced by etching can also be used. In all of the coupling wave guides $H_1$–$H_6$ branching off from the main wave guide HH, only the $H_{10}$ fundamental wave type is capable of propagation. The wave guides $H_1$–$H_6$ are preferably embodied as standard wave guides of a type known in the art.

The design of the mode coupler 100 according to the invention makes possible its production by an electroforming process. This kind of production is especially advantageous for applications involving electromagnetic waves of millimeter lengths. When producing the mode coupler 100 by an electroforming process, a horn, which can be a pyramidal horn (not shown) or a corrugated horn, can be integrated in a simple manner at an antenna output A of the mode coupler 100, so that the shape and width of the beams supplied to the mode coupler 100 by the antenna feed system can be varied. The version with a corrugated horn especially has the advantage of identical beams for the two orthogonal sum modes.

Figure 3A:
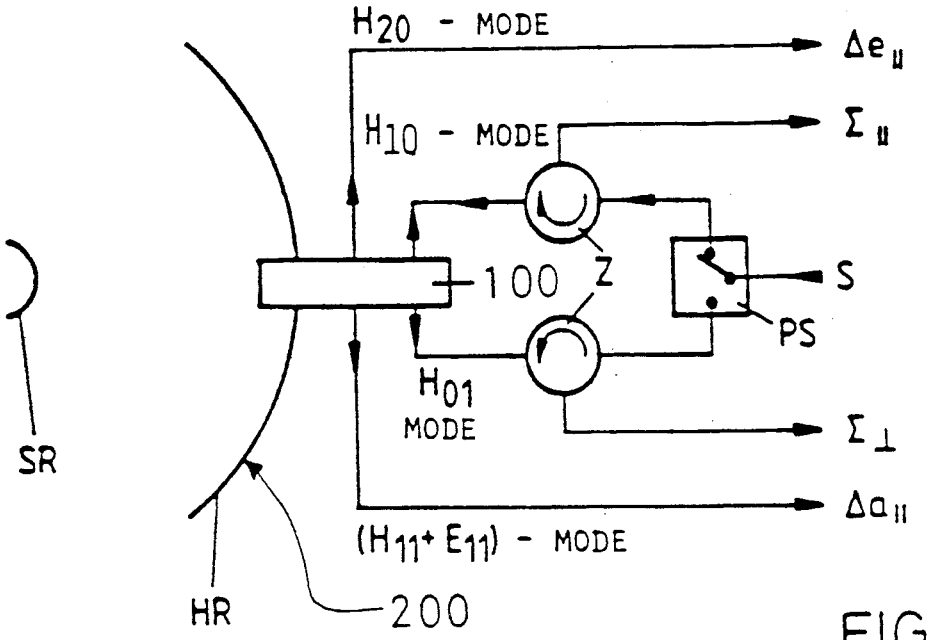
FIGS. 3*a* and 3*b* are schematic diagrams respectively showing alternative operating modes, and the respective output signals for a mode coupler according to the invention in an antenna feed system.
Figure 3B:
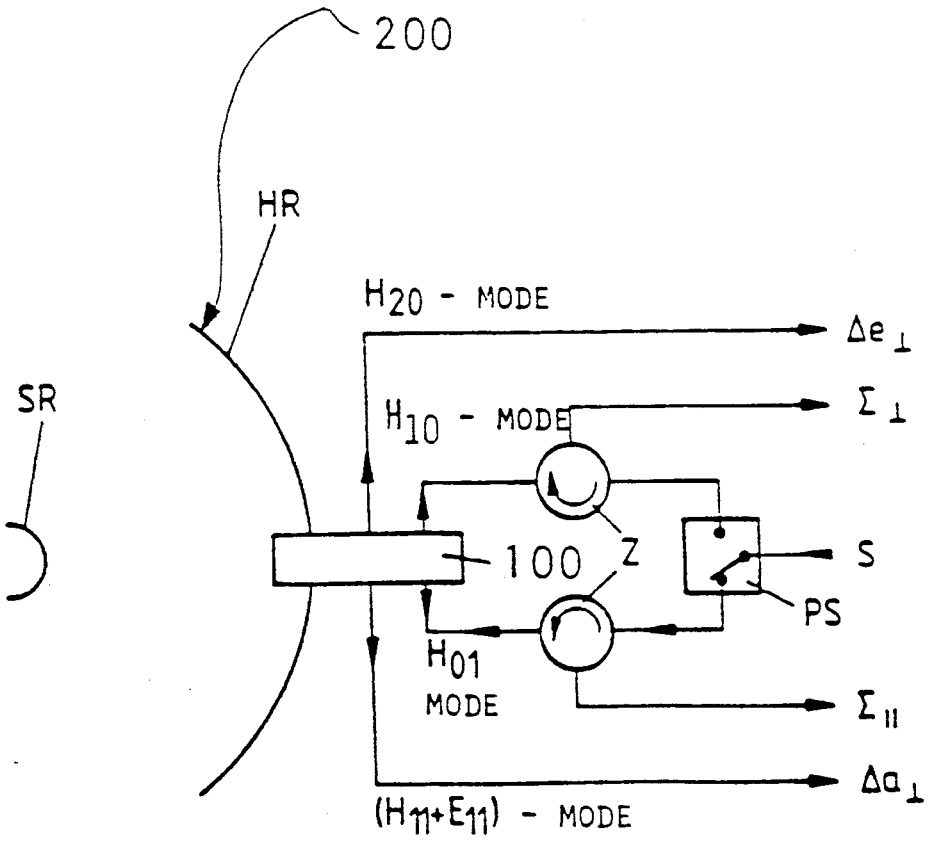

In FIGS. 3*a* and 3*b*, two alternative operating modes of an antenna feed system are shown when a reflector antenna 200 having a main reflector HR and a subreflector SR is used with the mode coupler 100. As shown in FIGS. 3*a* and 3*b*, a pair of circulators Z are connected between a p-i-n diode switch PS and the mode coupler 100, and serve to decouple the transmit and receive paths of the antenna feed system. If as shown in FIG. 3*a* a transmitted signal S is switched via the p-i-n diode switch PS to the $H_{10}$ mode port, i.e., the wave guide $H_4$, then using the mode coupler 100 according to the invention, the following signals reflected from a target (not shown) can be received at the following ports:

The $H_{10}$ port (wave guide $H_4$) providing a sum signal component $\Sigma\,||$ which is not rotated in a polarization direction;

The $H_{20}$ port (wave guide $H_3$) and the ($H_{11}+E_{11}$) port (wave guide $H_2$) provide differential signal components $\Delta e\,||$ and $\Delta a\,||$, respectively, which are not rotated in the polarization direction; and The $H_{01}$ port (wave guide $H_1$) provides a sum signal component $\Sigma\perp$ which is rotated by 90° in the polarization direction.

If transmission of the transmitted signal S, on the other hand, is via the $H_{01}$ port (wave guide $H_6$), then the following signals reflected from the target are received corresponding to the arrangement shown in FIG. 3*b*:

The $H_{10}$ port (wave guide $H_4$) provides a sum signal a component $\Sigma\perp$ rotated by 90° in the polarization direction;

The $H_{20}$ port (wave guide $H_3$) and the ($H_{11}+E_{11}$) mode port (wave guide $H_2$) provide differential signal components $\Delta e\perp$ and $\Delta a\perp$, respectively, which are rotated in the polarization direction; and The $H_{01}$ port (wave guide $H_1$) provides a sum signal component $\Sigma \parallel$ which is not rotated in the polarization direction.

By switching the transmitted signal S from the $H_{10}$ mode port to the $H_{01}$ mode port or vice versa, it is possible to detect and home in with maximum sensitivity both on those targets which are not rotating with the polarization and on those targets which are rotating with the polarization, or to draw conclusions from the ratio of the outputs in both polarizations as to properties of the target. Furthermore in this way the reflections of undesired targets can be partially suppressed.

For transmission and reception of signals having a circular polarization, a polarization converter may be provided at the antenna output A of the mode coupler 100. This polarization converter—not shown—must act on all the wave types involved and should therefore be embodied as a large-surface-area array in front of the mode coupler 100 (for instance in the form of a disk of double refraction material or a metal grid structure). The aforementioned advantages of the arrangement are maintained, because depending on the direction of -rotation of the reflected waves generally a distinction can still be made between targets that, upon signal reflection, maintain the direction of rotation of the wave and those that reverse the direction of rotation of the wave.

It will be understood that the above description of the present invention is susceptible to various modifications, changes and adaptations, and the same are intended to be comprehended within the meaning and range of equivalents of the appended claims.

What is claimed is:

1. In a mode coupler for monopulse applications in an antenna feed system for obtaining angle deviations in azimuth and elevation, said coupler having a rectangular main wave guide with a portion at one end in which a plurality of electromagnetic wave modes, including a dominant $H_{10}$ mode, and higher order $H_{20}$ and $(H_{11}+E_{11})$ modes, of an illuminating signal can be propagated, a plurality of mode-selective input and output coupling ports which are all formed as respective simple standard rectangular wave guides mounted on the main wave guide where each standard rectangular wave guide has a shorter and a longer cross-sectional axis and is of a size for propagation of only said $H_{10}$ mode, means for coupling out the $(H_{11}+E_{11})$ mode including a separator plate means disposed in said main wave guide portion for converting the $(H_{11}+E_{11})$ mode into two phase-opposed wave guide waves and for coupling said two waves, via a coupling loop, into one of said standard wave guides which is mounted on a side of said main wave guide portion, and which has its said longer cross-sectional axis transverse to a longitudinal axis of said main wave guide, said separation plate means being disposed so that a front edge of said separator plate means is a reflector for the $H_{01}$ mode, means for coupling out the $H_{10}$ mode including a further one of said standard wave guides connected to an end of said main wave guide opposed said one end and having a longitudinal axis extending parallel to said longitudinal axis of said main wave guide, and means for coupling out the $H_{01}$ mode including at least one of said standard wave guides, the improvement wherein:

said means for coupling out the $H_{01}$ mode from said main wave guide portion includes a pair of said standard wave guides having first respective ends mounted symmetrically on opposite sides of said main wave guide portion adjacent said front edge of said separator plate means and having their respective other ends connected by a wave guide junction, consisting of an H-plane junction, to a common output of one of said standard wave guides.

2. A mode coupler as defined in claim 1 further comprising means for coupling out the $H_{20}$ mode including another one of said standard wave guides laterally mounted on said main guide.

3. A mode coupler as defined in claim 2 wherein: said main wave guide includes a further portion which is disposed between said front portion and said standard wave guide for coupling out the $H_{10}$ mode, and has a varying cross-section along its longitudinal axis which reduces in size from a cross-section of said front portion to that of said standard wave guide; and said standard wave guide of said means for coupling out the $H_{20}$ mode is mounted on a side of said further portion of said main wave guide.

4. A mode coupler as defined in claim 2, wherein said coupling ports for said $H_{10}$ and $H_{01}$ modes are input-/output ports.

5. A mode coupler as defined in claim 1, further comprising an antenna coupled to said one end of said main wave guide, with said antenna being in the shape of a pyramidal horn.

* * * * *